US008959688B2

(12) United States Patent
Im et al.

(10) Patent No.: US 8,959,688 B2
(45) Date of Patent: Feb. 24, 2015

(54) WASHING MACHINE AND CONTROL METHOD THEREOF

(75) Inventors: Tae Hui Im, Gyeonggi-do (KR); Jung Ran Jung, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 858 days.

(21) Appl. No.: 12/659,460

(22) Filed: Mar. 9, 2010

(65) Prior Publication Data

US 2010/0325815 A1 Dec. 30, 2010

(30) Foreign Application Priority Data

Jun. 30, 2009 (KR) ..... 10-2009-0059124

(51) Int. Cl.

| | |
|---|---|
| ***D06F 33/00*** | (2006.01) |
| ***D06F 39/08*** | (2006.01) |
| ***D06F 33/02*** | (2006.01) |
| ***D06F 39/00*** | (2006.01) |

(52) U.S. Cl.

CPC ..... *D06F 33/02* (2013.01); *D06F 39/087* (2013.01); *D06F 39/003* (2013.01)

USPC ..... 8/158; 68/12.05

(58) Field of Classification Search

USPC ..... 8/158, 159; 68/23 R, 23.5, 53, 62, 133, 68/207

See application file for complete search history.

(56) References Cited

U.S. PATENT DOCUMENTS

| | | | | |
|---|---|---|---|---|
| 5,167,722 | A * | 12/1992 | Pastryk et al. | 134/33 |
| 5,504,955 | A * | 4/1996 | Mueller et al. | 8/158 |
| 6,134,925 | A * | 10/2000 | Fujii et al. | 68/12.04 |
| 7,017,217 | B2 * | 3/2006 | Johanski et al. | 8/158 |
| 7,269,870 | B2 * | 9/2007 | Kim | 8/158 |
| 7,376,997 | B2 * | 5/2008 | Kim et al. | 8/159 |
| 7,578,019 | B2 * | 8/2009 | La Belle et al. | 8/159 |
| 7,636,973 | B2 * | 12/2009 | Shaffer | 8/159 |
| 2001/0027579 | A1 * | 10/2001 | Kwon | 8/158 |
| 2004/0010860 | A1 * | 1/2004 | Johanski et al. | 8/158 |

(Continued)

FOREIGN PATENT DOCUMENTS

| | | | |
|---|---|---|---|
| CN | 1429942 | A | 7/2003 |
| CN | 101824729 | A | 9/2010 |

(Continued)

OTHER PUBLICATIONS

Chinese Office Action mailed on Jan. 4, 2013 in corresponding Chinese Patent Application No. 201010176678.7.

*Primary Examiner* — Joseph L Perrin
(74) *Attorney, Agent, or Firm* — Staas & Halsey LLP

(57) ABSTRACT

A washing machine that controls water supply modes of washing and rinsing operations and a control method thereof. For the washing operation, the wetting of the laundry is improved through the supply of water in unidirectional rotation in which the water is supplied while a washing tub and a pulsator are simultaneously rotated in one direction. For the rinsing operation, laundry is quickly separated from the washing tub, such that the laundry is sufficiently mixed with the water, through the supply of water in unidirectional rotation and the supply of water in alternating-direction rotation in which the water is supplied while only the pulsator is rotated in alternating directions, thereby achieving rinsing utilizing water supply time, and, in addition, turnover of the laundry is smoothly achieved such that washing residues present on the laundry are effectively removed from the laundry, thereby improving rinsing efficiency.

12 Claims, 17 Drawing Sheets

(56) References Cited

U.S. PATENT DOCUMENTS

| | | | | |
|---|---|---|---|---|
| 2004/0045097 | A1* | 3/2004 | Kim et al. | 8/159 |
| 2006/0000029 | A1* | 1/2006 | Park | 8/158 |
| 2006/0016021 | A1* | 1/2006 | Kim | 8/158 |
| 2010/0064445 | A1* | 3/2010 | Nieh et al. | 8/159 |

FOREIGN PATENT DOCUMENTS

| | | |
|---|---|---|
| GB | 622908 | 2/1945 |
| KR | 10-2003-0029725 | 4/2003 |
| KR | 10-2003-0029728 | 4/2003 |

* cited by examiner

WASHING MACHINE AND CONTROL METHOD THEREOF

CROSS-REFERENCE TO RELATED APPLICATIONS

This application claims the benefit of Korean Patent Application No. 2009-0059124, filed on Jun. 30, 2009 in the Korean Intellectual Property Office, the disclosure of which is incorporated herein by reference.

BACKGROUND

1. Field

Embodiments relate to a washing machine that controls water supply modes of washing and rinsing operations to improve washing and rinsing efficiencies and a control method thereof.

2. Description of the Related Art

Generally, a washing machine (for example, a fully automatic washing machine) is an apparatus, including a water tub to contain water (wash water or rinse water), a washing tub rotatably installed in the water tub to receive laundry, a pulsator rotatably installed in the washing tub to generate a water current for washing and rinsing operations, and a motor to generate a drive force necessary to rotate the washing tub and the pulsator, to remove contaminants from the laundry by surface activities of the water current and a detergent.

This washing machine detects the weight of laundry (load) to decide wash and rinse water levels according to a user's selection of a washing course, supplies water (specifically, wash water) and detergent into the water tub according to the decided wash water level, and rotates the pulsator in alternating directions according to the driving of the motor to generate a water current to transmit detergent water (water+detergent) to the laundry. In this manner, a washing operation is performed.

After the completion of the washing operation, the washing machine performs drainage and intermediate spin-drying. Subsequently, the washing machine supplies water (specifically, rinse water) into the water tub according to the decided rinse water level, and rotates the pulsator in alternating directions according to the driving of the motor to generate a water current to cause the water to contact the laundry. In this manner, a rinsing operation is performed.

The conventional washing machine, performing the washing and rinsing operations through the above series of processes, supplies water while the motor is stopped, with the result that laundry floats during the supply of wash water. For bulky laundry (for example, bedclothes), the floating of the laundry is serious, with the result that the laundry is not sufficiently wetted, and therefore, the washing performance is lowered.

Also, during the supply of rinse water, it takes time for the laundry, clinging to the washing tub due to intermediate spin-drying after the completion of the washing operation, to be separated from the washing tub, and rinsing time is wasted in correspondence to the laundry separation time. For bulky laundry (for example, bedclothes), the laundry separation time is increased. In a large-capacity washing machine (for example, a machine having a capacity of more than 14 Kg), it takes more than 40 seconds for the laundry to be separated from the washing tub after the completion of rinse water supply when the percentage of load is 100%, with the result that the laundry is not sufficiently wetted, and therefore, the washing performance is lowered.

SUMMARY

Therefore, it is an aspect to provide a washing machine that controls water supply modes of washing and rinsing operations to improve the wetting of laundry during the supply of wash water and the mixing between the laundry and water during the supply of rinse water, thereby improving washing and rinsing efficiencies and a control method thereof.

Additional aspects of the invention will be set forth in part in the description which follows and, in part, will be apparent from the description, or may be learned by practice of the invention.

In accordance with one aspect, a control method of a washing machine including a washing tub and a pulsator rotatably installed in the washing tub to generate a water current includes performing supply of water during unidirectional rotation to supply water while rotating the washing tub and the pulsator in one direction, performing supply of water during alternating-direction rotation to supply water while rotating the pulsator in alternating directions after the supply of water during unidirectional rotation, and performing a supply of water during no rotation to supply water while stopping the washing tub and the pulsator after the supply of water during alternating-direction rotation.

The water may be continuously supplied when performing the supply of water during unidirectional rotation, the supply of water during alternating-direction rotation, and the supply of water during no rotation.

The washing tub and the pulsator may be rotated in a clockwise or counterclockwise direction when performing the supply of water during unidirectional rotation.

The washing tub and the pulsator may be rotated at a speed of less than approximately 40 RPM when performing the supply of water during unidirectional rotation.

The washing machine may further include a motor to generate a drive force to rotate the washing tub and the pulsator, a spin-drying shaft coupled to the washing tub, a washing shaft provided at the spin-drying shaft to transmit the drive force from the motor to the pulsator, and a power switching unit to selectively transmit the drive force from the motor to the spin-drying shaft, and the drive force from the motor may be transmitted to the spin-drying shaft and the washing shaft to simultaneously rotate the washing tub and the pulsator according to a downward movement of the power switching unit when performing the supply of water during unidirectional rotation.

The drive force from the motor may be transmitted to the washing shaft to rotate the pulsator according to an upward movement of the power switching unit when performing the supply of water during alternating-direction rotation.

The control method may further include determining whether the supply of water is for a rinsing operation and performing the supply of water during unidirectional rotation for the rinsing operation from a commencement of water supply to a first water level when the supply of water is for the rinsing operation.

The supply of water during alternating-direction rotation for the rinsing operation may be performed from the first water level to a second water level.

The supply of water during no rotation for the rinsing operation may be performed from the second water level to a third water level.

The third water level may be a target water level set based on the weight of laundry received in the washing tub.

The water may be supplied to satisfy the following inequality: an amount of water supplied to the first water level<an amount of water supplied to the second water level<an amount of water supplied to the third water level.

The control method may further include determining whether the supply of water is for a washing operation and performing the supply of water during no rotation immediately after the supply of water during unidirectional rotation when the supply of water is for the washing operation.

Operation rates of the washing tub and the pulsator may be differently controlled according to a washing course during the supply of water during unidirectional rotation for the washing operation.

In accordance with another aspect, a control method of a washing machine includes determining whether spin-drying has been completed, supplying water to a first water level while rotating a washing tub and a pulsator in one direction when the spin-drying has been completed, supplying water to a second water level while rotating the pulsator in alternating directions when the water has reached the first water level, and supplying water to a third water level while stopping the washing tub and the pulsator when the water has reached the second water level.

The third water level may be a target water level for a washing or rinsing operation.

The washing machine may further include a motor to generate a drive force to rotate the washing tub and the pulsator, a spin-drying shaft coupled to the washing tub, a washing shaft provided at the spin-drying shaft to transmit the drive force from the motor to the pulsator, and a power switching unit to selectively transmit the drive force from the motor to the spin-drying shaft, and the drive force from the motor may be transmitted to the spin-drying shaft and the washing shaft to simultaneously rotate the washing tub and the pulsator until the water reaches the first water level according to a downward movement of the power switching unit.

The drive force from the motor may be transmitted to the washing shaft to rotate the pulsator until the water reaches the second water level according to an upward movement of the power switching unit.

In accordance with a further aspect, a washing machine includes a washing tub to receive laundry, a pulsator rotatably installed in the washing tub, a motor to rotate the washing tub and the pulsator, a water supply unit to supply water to the washing tub, and a controller to control the water supply unit to supply water to the washing tub and to control the motor to perform a supply of water during unidirectional rotation to rotate the washing tub and the pulsator in one direction, a supply of water during alternating-direction rotation to rotate the pulsator in alternating directions, and a supply of water during no rotation to stop the washing tub and the pulsator, according to a predetermined water level during the supply of water.

The controller may control the washing tub and the pulsator to be rotated in a clockwise or counterclockwise direction when performing the supply of water during unidirectional rotation.

The controller may control the supply of water during unidirectional rotation while rotating the motor at a speed of less than approximately 40 RPM.

The controller may determine whether the supply of water is for a rinsing operation, and may continuously perform the supply of water during unidirectional rotation, the supply of water during alternating-direction rotation, and the supply of water during no rotation when the supply of water is for the rinsing operation.

The controller may determine whether the supply of water is for a washing operation, and may perform the supply of water during unidirectional rotation and the supply of water during no rotation when the supply of water is for the washing operation.

The controller may control the supply of water during unidirectional rotation while changing an operation rate of the motor according to a washing course.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
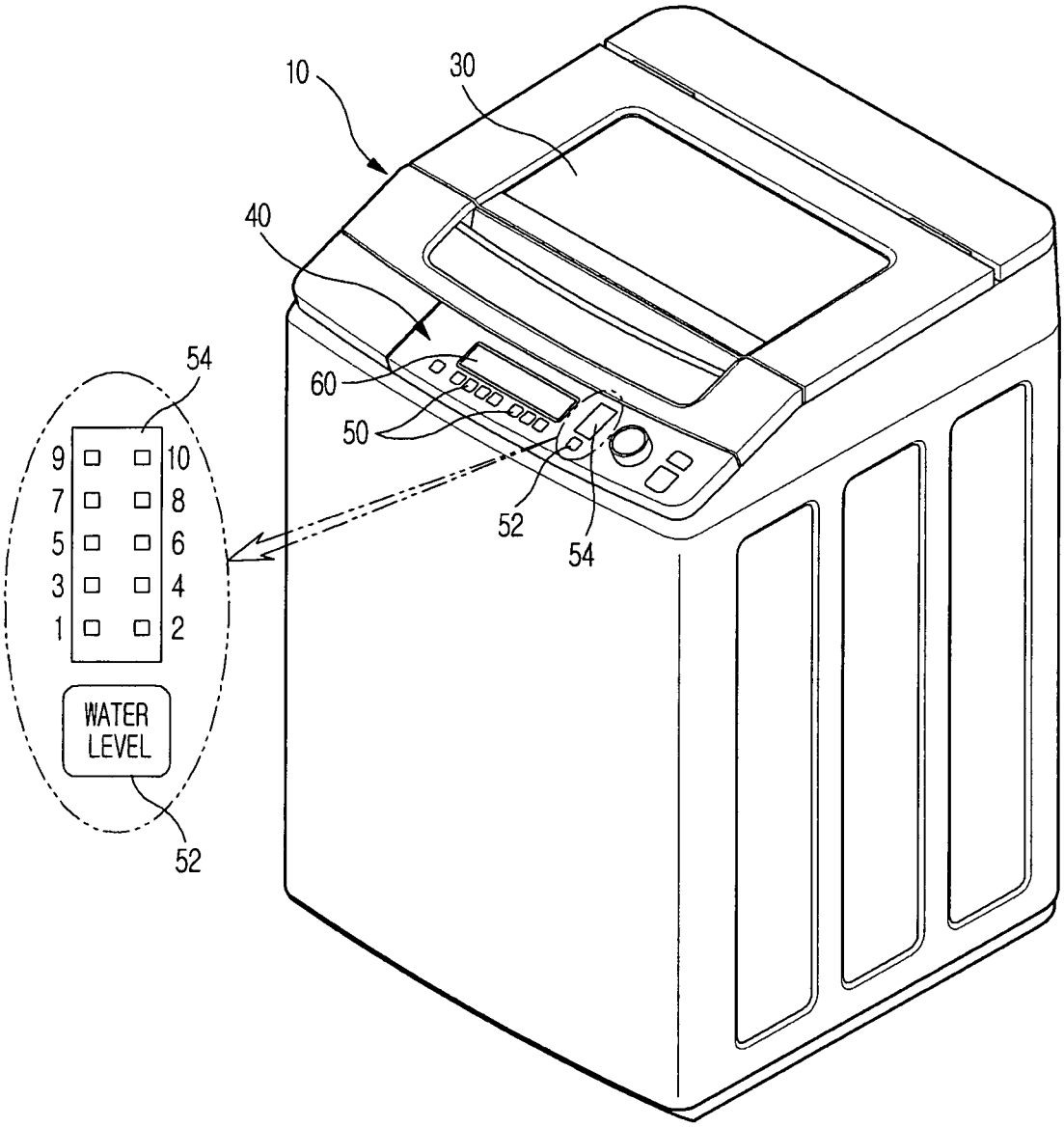
FIG. 1 is a perspective view illustrating the external appearance of a washing machine according to an embodiment.

Reference will now be made in detail to the embodiments of the present invention, examples of which are illustrated in the accompanying drawings, wherein like reference numerals refer to like elements throughout.

FIG. 1 is a perspective view illustrating the external appearance of a washing machine according to an embodiment.

Referring to FIG. 1, the washing machine includes a machine body 10 forming the external appearance of the washing machine, a door 30 provided at the top of the machine body 10 to allow laundry to be put into the machine body 10, and a control panel 40 provided at one side of the door 30 to control operation of the washing machine.

The control panel 40 includes an input unit 50 to input a user command related to a washing course and an operation of the washing machine and a display unit 60 to display the washing course and the operation of the washing machine. The input unit 50 includes a plurality of buttons (soaking, washing, rinsing, spin-drying, water supply, water level, etc.) to input a user command related to the operation of the washing machine. Among the buttons is a water level button 52 to select the level (specifically, rinse water level) of water to be supplied into the washing machine. When a user manipulates the water level button 52 to select a desired water level, an LED 54 corresponding to the selected water level is lit such that the user confirms the selected water level.

Figure 2:
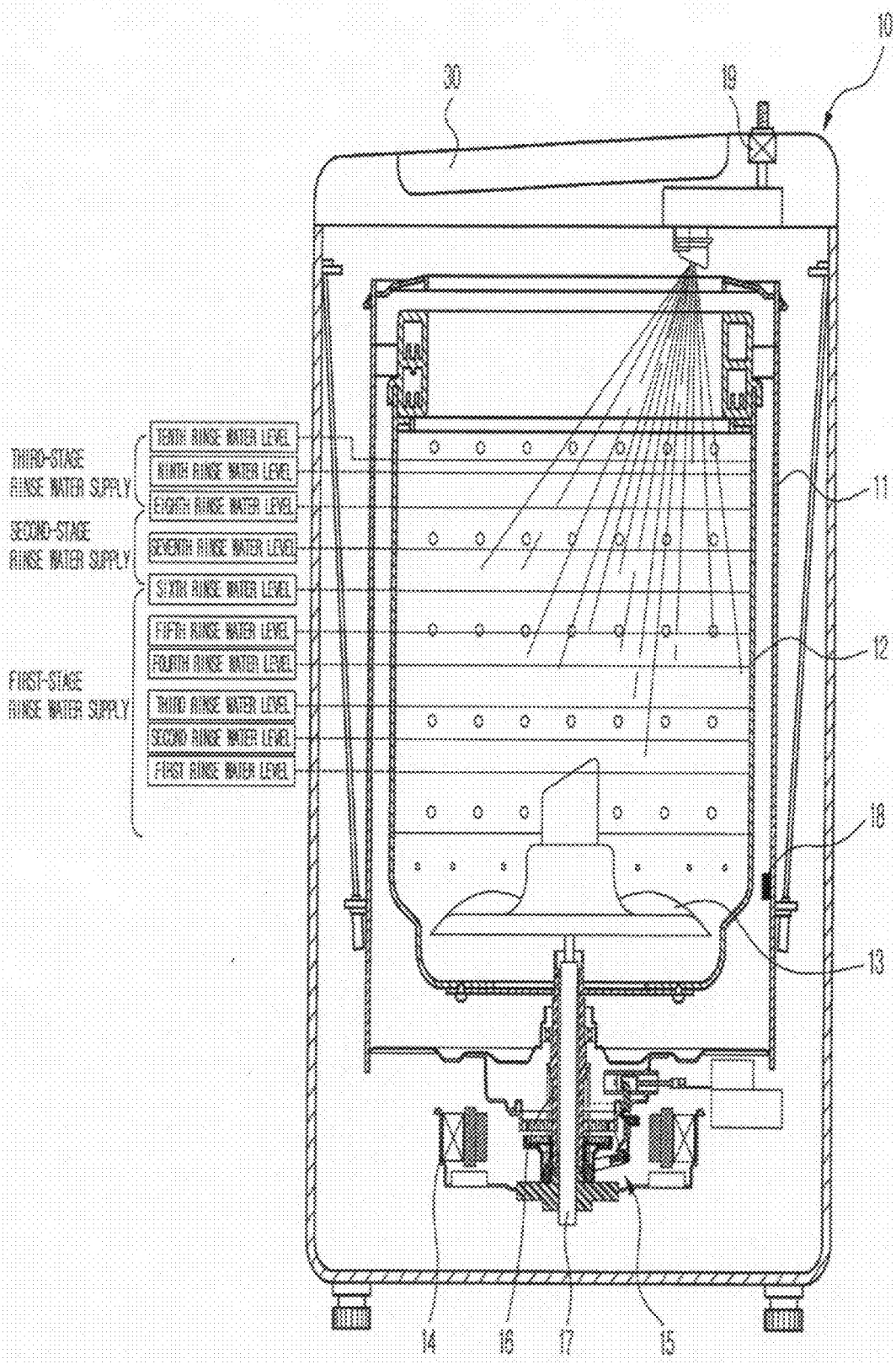
FIG. 2 is a sectional view illustrating the structure of the washing machine according to an embodiment.

FIG. 2 is a sectional view illustrating the structure of the washing machine according to an embodiment.

Referring to FIG. 2, the washing machine includes a water tub 11 installed in the machine body 10 to contain water (wash water or rinse water), a washing tub 12 rotatably installed in the water tub 11 to receive laundry, and a pulsator 13 rotatably installed in the washing tub 12 to generate a water current during the rotation of the pulsator 13 in alternating directions.

Below the water tub 11 are mounted a motor 14 to generate a drive force necessary to rotate the washing tub 12 and the pulsator 13 and a power switching unit 15 to simultaneously or selectively transmit the drive force from the motor 14 to the washing tub 12 and the pulsator 13.

The motor 14 is a direct drive (DD) type motor with a variable speed function. The motor 14 simultaneously or selectively transmits the drive force to the washing tub 12 and the pulsator 13 according to the upward or downward movement of the power switching unit 15. Reference numeral 16 indicates a hollow spin-drying shaft coupled to the washing tub 12, and reference numeral 17 indicates a washing shaft mounted at a hollow part of the spin-drying shaft 16 such that the washing shaft 17 is connected to the pulsator 13 through the water tub 11 and the spin-drying shaft 16.

Inside the lower part of the water tub 11 is mounted a water level sensor 18 to sense a frequency which changes depending upon a water level to sense the amount of water (the water level) in the water tub 11.

The water level sensor 18 controls a reference wash water level (an optimum water level for laundry wetting), which is an amount of water supplied when the washing tub 12 and the pulsator 13 are simultaneously rotated in one direction according to the driving of the motor 14 during the supply of wash water, and a target wash water level (a target water level for a washing operation), which is an amount of water supplied while the motor 14 is stopped. The water level sensor 18 checks a water level frequency after the commencement of water supply such that water supply during unidirectional rotation is performed to the reference wash water level, and the water supply during no rotation is performed from the reference wash water level to the target water level.

Also, the water level sensor 18 controls a water supply change water level (a sixth rinse water level based on the highest water level; hereinafter, referred to as a first water level), which is an amount of water supplied when the washing tub 12 and the pulsator 13 are simultaneously rotated in one direction according to the driving of the motor 14 during the supply of rinse water, a reference rinse water level (a rinse water level between a seventh water level and an eighth water level based on the highest water level, specifically a water level corresponding to a target water level+500 Hz; hereinafter, referred to as a second water level), which is an amount of water supplied when the pulsator 13 is rotated in alternating directions according to the driving of the motor 14, and a target rinse water level (a tenth rinse water level based on the highest water level; hereinafter, referred to as a third water level), which is an amount of water supplied while the motor 14 is stopped. The water level sensor 18 checks a water level frequency after the commencement of water supply such that water supply during unidirectional rotation is performed to the first water level, water supply during alternating-direction rotation is performed from the first water level to the second water level, and the water supply during no rotation is performed from the second water level to the third water level.

Above the water tub 11 is mounted a water supply valve 19 to supply water to the water tub 11. The water supply valve 19 adjusts the supply of water according to the manipulation of the water level button 52.

Also, in FIG. 2, levels of rinse water supplied to the water tub 11 are classified into a first rinse water level to a tenth rinse water level. For a washing machine having a capacity of 16 Kg, the first to third rinse water levels are the lowest water levels, the fourth and fifth rinse water levels are low water levels, the sixth and seventh rinse water levels are intermediate water levels, the eighth and ninth rinse water levels are the high water levels, and the tenth rinse water level is the highest water level.

In this embodiment, meanwhile, the ninth rinse water level is lower than the tenth rinse water level for easy understanding of this embodiment, although the ninth rinse water level may be higher than the tenth rinse water level in the aspect of design.

Figure 3:
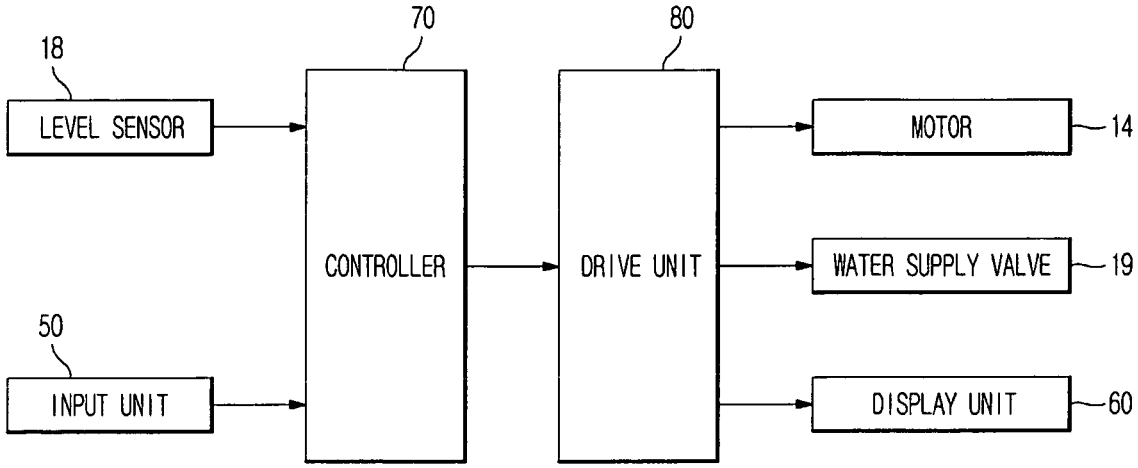
FIG. 3 is a control block diagram of the washing machine according to the embodiment.

FIG. 3 is a control block diagram of the washing machine according to the embodiment of the present invention. The washing machine includes an input unit 50, a display unit 60, a controller 70, and a drive unit 80.

The input unit 50 inputs a washing course (for example, a normal course or a wool course) selected by a user and a user command related to an operation of the washing machine. The display unit 60 displays the washing course selected by the user and the operation of the washing machine according to a display control signal from the controller 70.

The controller 70 is a microprocessor to control the entire operation of the washing machine, such as washing, rinsing, and spin-drying, according to the user command input from the input unit 50. The controller 70 sets wash and rinse water levels, motor RPM and operation rate (motor on-off time), and washing and rinsing time based upon load (the weight of laundry) in the selected washing course. The controller 70 controls water supply modes of washing and rinsing operations to improve washing and rinsing efficiencies.

More specifically, the controller 70 controls the supply of water during unidirectional rotation, in which the water is supplied while the motor 14 is driven to simultaneously rotate the washing tub 12 and the pulsator 13 in one direction, to the reference wash water level during the supply of wash water, and controls the supply of water with the motor 14 stopped from the reference wash water level to the target wash water level, to improve the wetting of laundry during the supply of wash water and the effectiveness of a water current at an early stage of washing such that smooth movement of the laundry is achieved, thereby improving washing efficiency.

Also, the controller 70 controls the supply of water during unidirectional rotation, in which the water is supplied while the motor 14 is driven to simultaneously rotate the washing tub 12 and the pulsator 13 in one direction, to the first water level during the supply of rinse water, controls the supply of water during alternating-direction rotation, in which the water is supplied while the motor 14 is driven to rotate the pulsator 13 in alternating directions, from the first water level to the second water level, and controls the supply of water with the motor 14 stopped from the second water level to the third water level, to quickly separate laundry clinging to the washing tub 12 due to intermediate spin-drying after the completion of the washing operation, from the washing tub 12 such that the laundry is sufficiently mixed with the water, thereby achieving rinsing utilizing water supply time, and, in addition, to easily achieve turnover of the laundry such that washing residues (specifically, foreign matter such as detergent waste and lint) present on the laundry are effectively removed from the laundry, thereby improving rinsing efficiency.

The drive unit 80 drives the motor 14 and the water supply valve 19 according to a drive control signal from the controller 70.

Hereinafter, a control method of the washing machine with the above-stated construction will be described.

Figure 4A:
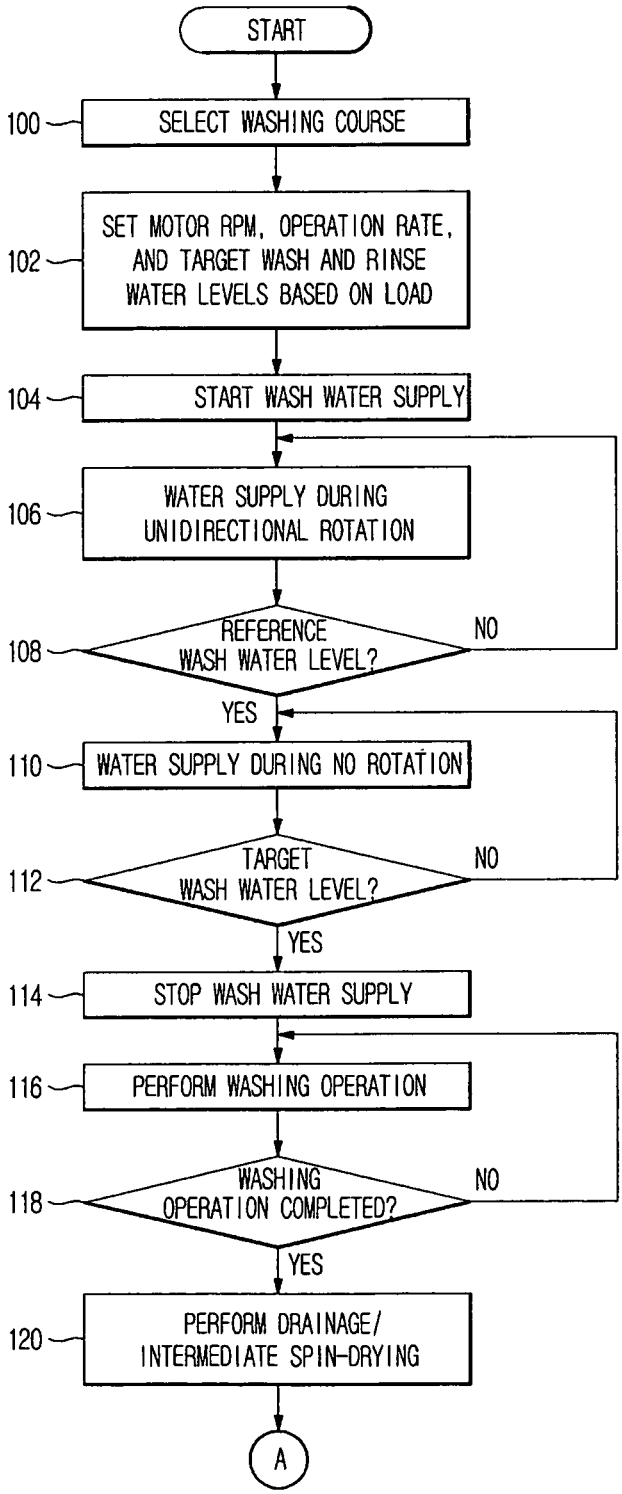
FIGS. 4A and 4B are flow charts illustrating water supply control of the washing machine according to the embodiment.
Figure 4B:
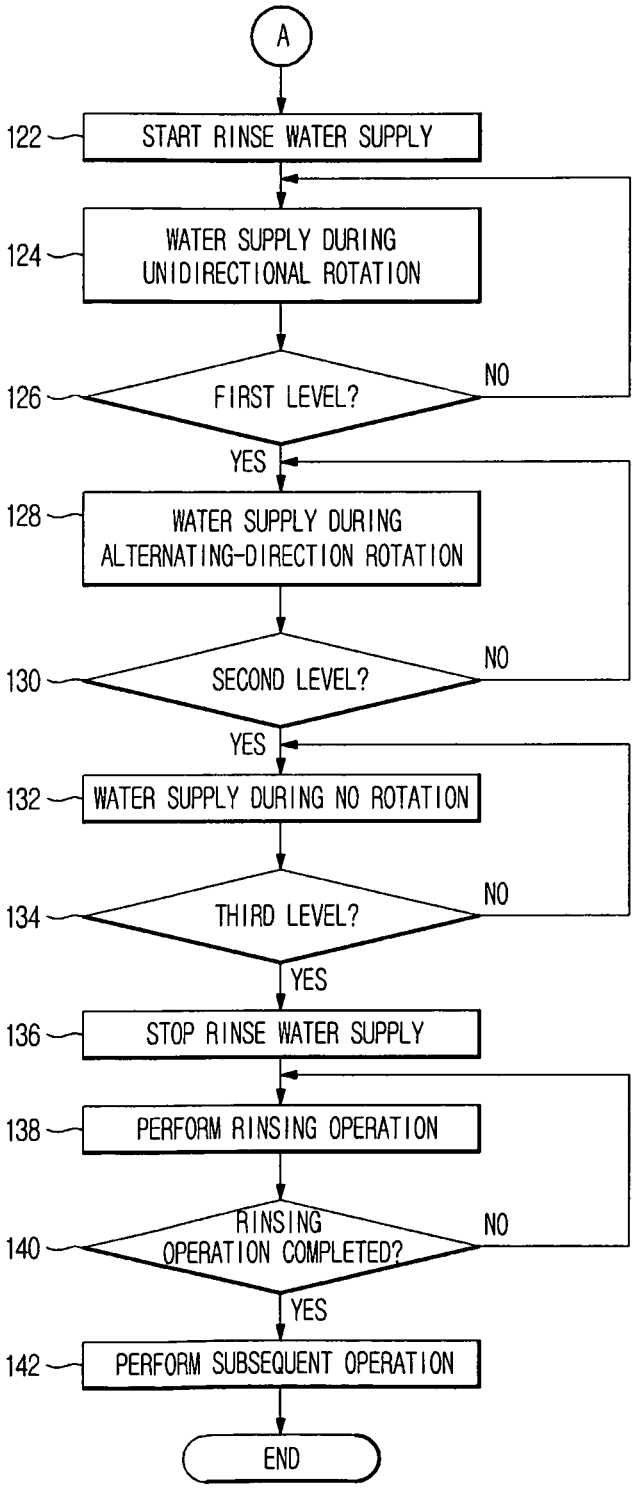

FIGS. 4A and 4B are flow charts illustrating water supply control of the washing machine according to the embodiment, which relate to water supply modes of washing and rinsing operations to improve washing and rinsing efficiencies In FIGS. 4A and 4B, when a user puts laundry into the washing tub 12 and inputs a washing course (for example, a normal course corresponding to a capacity of 16 Kg) based on kind of the laundry and a user command related to an operation of the washing machine (100), the user command is input to the controller 70 via the input unit 50.

The controller 70 controls washing and rinsing operations to be performed according to the user command input from the input unit 50. First, the controller 70 detects load (weight of the laundry) placed in the washing tub 12 and sets motor RPM and operation rate (motor on-off time), a target wash water level and a target rinse water level, and washing and rinsing time based on the detected load (102).

Subsequently, the controller 70 controls wash water to be supplied to perform the washing operation (104). When the water supply valve 19 is turned on by the drive unit 80 to supply the wash water, the water supply valve 19 is opened to supply water (wash water) to the water tub 11. At the same time, the controller 70 drives the motor 14 through the drive unit 80 to perform the supply of water during unidirectional rotation in which the water (wash water) is supplied while the washing tub 12 and the pulsator 13 are simultaneously rotated in one direction (106).

In the washing operation, the target motor RPM to simultaneously rotate the washing tub 12 and the pulsator 13 in one direction is approximately 25 RPM, and the operation rate is changed based on the washing course. For a normal course, for example, the operation rate is set to 1-second motor on/5-second motor off. For a wool course, the operation rate is set to 4-second motor on/16-second motor off, which minimizes wool shrinkage.

When the water (wash water) is supplied while the washing tub 12 and the pulsator 13 are simultaneously rotated in one direction, the wetting of the laundry is improved, and therefore, the laundry sinks during the supply of water. As a result, the distance between the laundry and the pulsator 13 is decreased. As the distance between the laundry and the pulsator 13 is decreased, the movement of the laundry is improved, which increases the effectiveness of a water current at an early stage of washing.

During the supply of water during unidirectional rotation in which the water is supplied while the washing tub 12 and the pulsator 13 are simultaneously rotated in one direction, a frequency changing depending upon the level of the water supplied to the water tub 11 is sensed by the water level sensor 18, and it is determined whether the water has reached a predetermined reference wash water level (an optimum water level for laundry wetting) (108). When it is determined that the water has not reached the reference wash water level, the supply of water during unidirectional rotation is continued.

When it is determined at Operation 108 that the water has reached the reference wash water level, the controller 70 controls the motor 14 to be stopped and performs the supply of water during no rotation in which water (wash water) is supplied while the motor 14 is stopped (110).

Even at the moment when switching is performed from the supply of water during unidirectional rotation to the supply of water during no rotation, the water supply valve 19 remains open to continuously supply water irrespective of whether the motor 14 is driven or not.

When the water (wash water) is supplied while the motor 14 is stopped, a target wash water level necessary for the washing operation is accurately obtained.

During the supply of water during no rotation in which the water is supplied while the motor 14 stopped, a frequency changing depending upon the level of the water supplied to the water tub 11 is sensed by the water level sensor 18, and it is determined whether the water has reached a predetermined target wash water level (a target water level for the washing operation) (112). When it is determined that the water has not reached the target wash water level, the supply of water during no rotation is continued.

When it is determined at Operation 112 that the water has reached the target wash water level, the controller 70 controls the water supply valve 19 to be turned off to stop the supply of wash water (114).

When the supply of water to the target wash water level is completed, the controller 70 controls the motor 14 to be driven to rotate the pulsator 13 in alternating directions. As a result, a water current to transmit detergent water (water+detergent) to the laundry, and the washing operation, is performed (116).

When the washing operation is completed (118), drainage and intermediate spin-drying are performed (120).

Figure 5A:
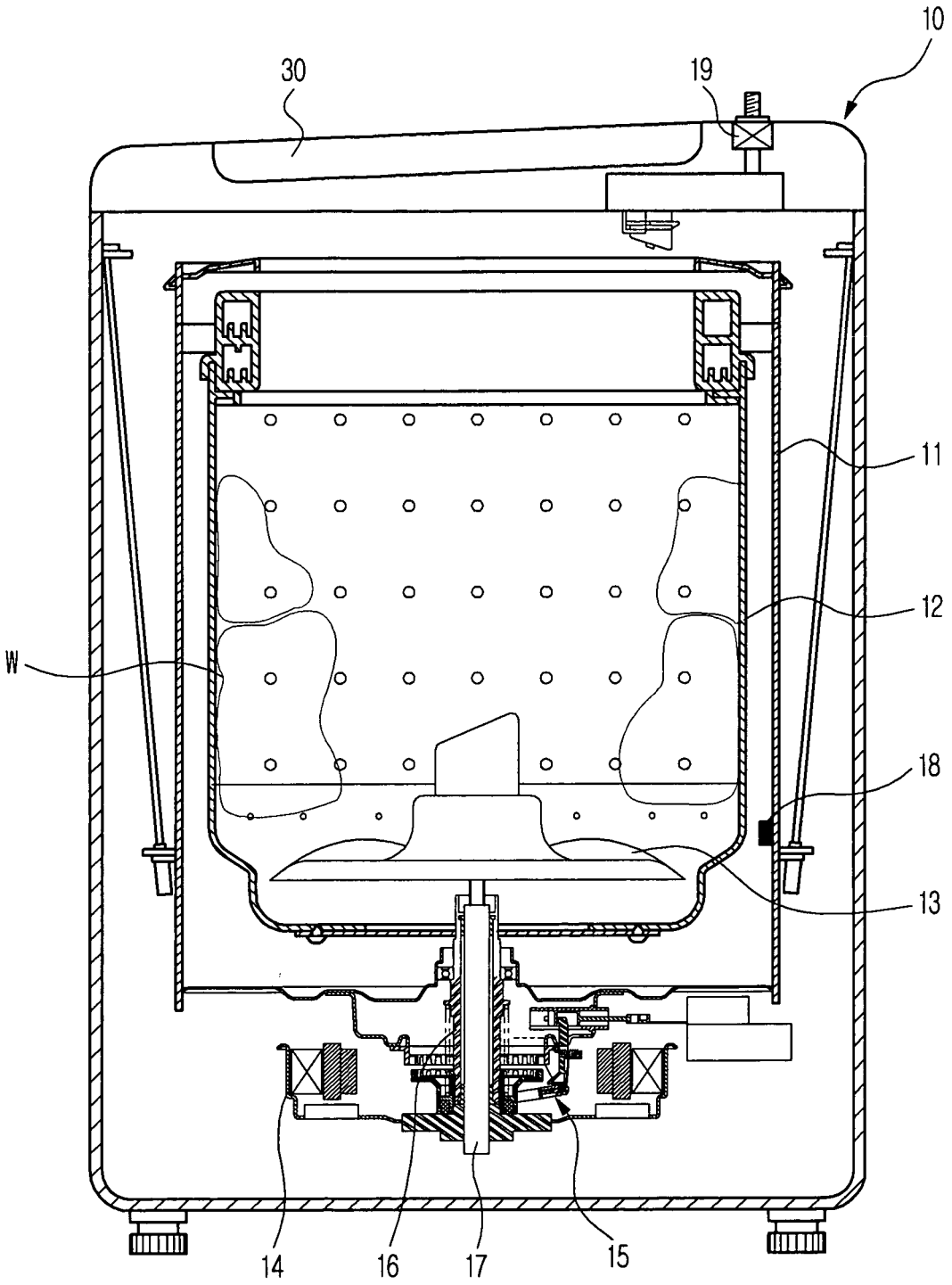
FIGS. 5A to 5D are sectional views illustrating rinse water supply control processes of the washing machine according to the embodiment.

When the spin-drying is performed after the washing operation, as shown in FIG. 5A, laundry W clings to the washing tub 12, with the result that it takes time for the laundry W to be separated from the washing tub 12 in a subsequent rinsing operation, and rinsing time is wasted in correspondence to the laundry separation time. For bulky laundry W (for example, bedclothes), the laundry separation time is increased, with the result that the laundry W is not sufficiently mixed with water, and therefore, the subsequent rinsing operation may not be smoothly performed.

In this embodiment, the laundry W, clinging to the washing tub 12, is quickly separated from the washing tub 12 through the supply of water during the rinsing operation, with the result that the laundry W is sufficiently mixed with the water without waste of rinsing time, thereby achieving rinsing utilizing water supply time. Also, rotation is performed while the laundry W is slightly separated from the wall of the washing tub 12, with the result that turnover of the laundry W is easily achieved such that washing residues (specifically, foreign matter such as detergent waste and lint) present on the laundry W are effectively removed from the laundry W, thereby improving rinsing efficiency.

To this end, the controller 70 controls the supply of rinse water to be commenced to perform the rinsing operation (122). When the supply of rinse water is commenced, as shown in FIG. 5A, the laundry W clings to the wall of the washing tub 12.

Figure 5B:
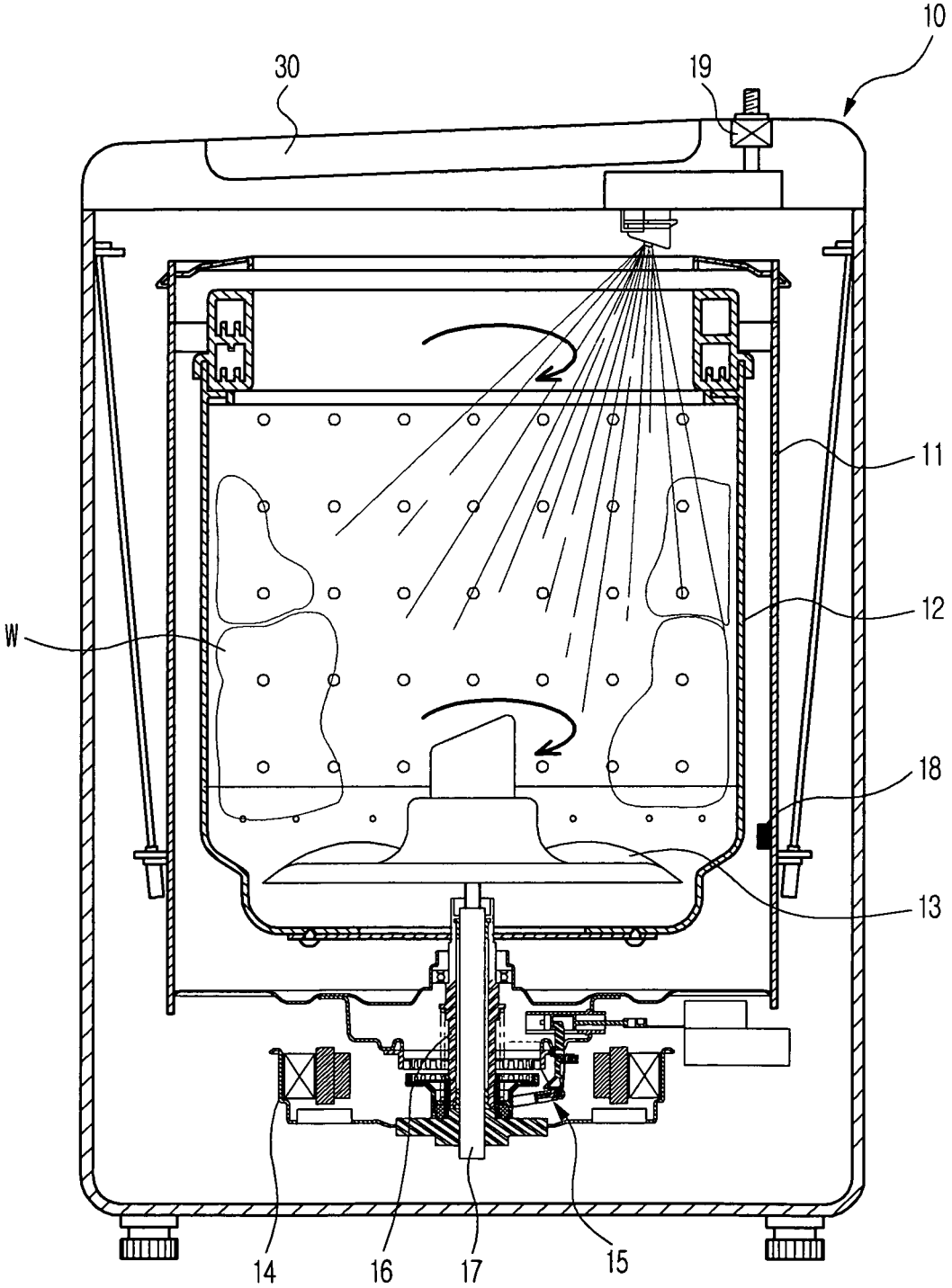

Subsequently, the controller 70 turns the water supply valve 19 through the drive unit 80 to perform the supply of rinse water. As a result, the water supply valve 19 is opened to supply water (rinse water) to the water tub 11. At the same time, the controller 70 drives the motor 14 through the drive unit 80 to simultaneously rotate the washing tub 12 and the pulsator 13, as shown in FIG. 5B, to perform the supply of water during unidirectional rotation (124).

For the supply of water during unidirectional rotation in which the water (rinse water) is supplied while the washing tub 12 and the pulsator 13 are simultaneously rotated in one direction, the power switching unit 15 is moved downward to simultaneously transmit a drive force from the motor 14 to the washing tub 12 and the pulsator 13.

When the power switching unit 15 is moved downward, the drive force from the motor 14 is transmitted to the washing shaft 17 and the spin-drying shaft 16, with the result that the washing tub 12 and the pulsator 13 are simultaneously rotated.

When the water (rinse water) is supplied while the washing tub 12 and the pulsator 13 are simultaneously rotated in one direction in this manner, the laundry, clinging to the washing tub 12 due to the spin-drying after the washing operation, is separated from the washing tub 12 and sufficiently mixed with the water, thereby achieving rinsing utilizing water supply time and thus improving rinsing efficiency.

Drive profiles of the motor 14 to simultaneously rotate the washing tub 12 and the pulsator 13 in one direction during the supply of water for the rinsing operation are shown in FIGS. 6A to 6D.

As shown in FIGS. 6A to 6D, a target RPM of the motor 14 to simultaneously rotate the washing tub 12 and the pulsator 13 in one direction during the rinsing operation is approximately 25 RPM (less than approximately 40 RPM). The motor 14 may be driven in the clockwise or counterclockwise direction. An operation rate (motor on-off time) is set to 10-second motor on/5-second motor off. The motor on/off is repeatedly performed to drive the motor at a low RPM and thus reduce a burden on the motor 14.

Figure 6A:
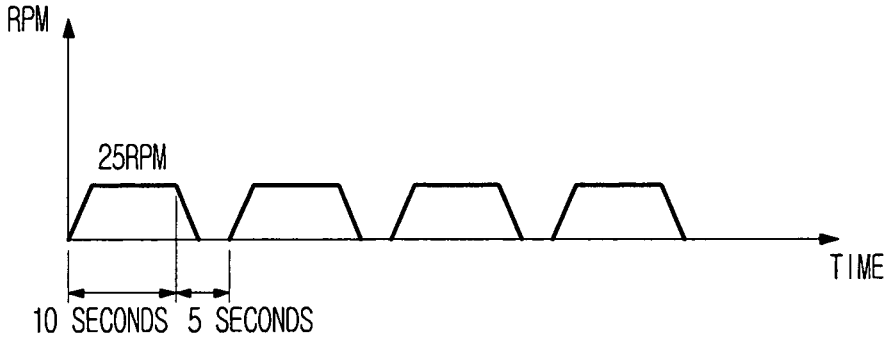
FIGS. 6A to 6D are graphs illustrating motor drive profiles of water supply during unidirectional rotation in rinse water supply of the washing machine according to the embodiment.

In FIG. 6A, the motor 14 is driven at an operation rate of 10-second motor on/5-second motor off to simultaneously rotate the washing tub 12 and the pulsator 13 in one direction, thereby improving wetting of the laundry W.

Figure 6B:
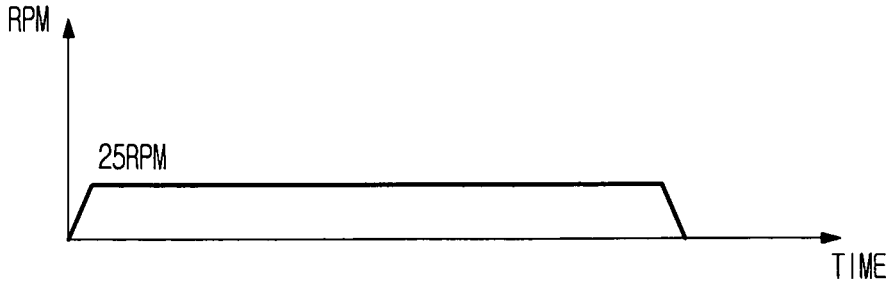

In FIG. 6B, the motor continues to be driven on while the supply of water during unidirectional rotation is performed to simultaneously rotate the washing tub 12 and the pulsator 13 in one direction, thereby improving wetting of the laundry W.

Figure 6C:
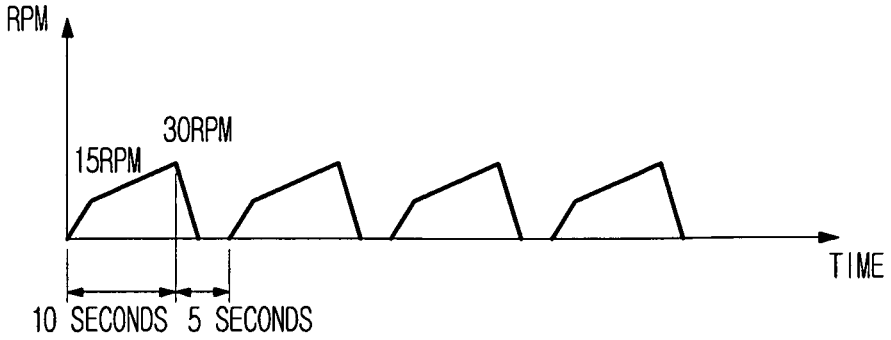

In FIG. 6C, the motor 14 is accelerated and stopped at an operation rate of 10-second motor on/5-second motor off to simultaneously rotate the washing tub 12 and the pulsator 13 in one direction, thereby improving wetting of the laundry W.

Figure 6D:
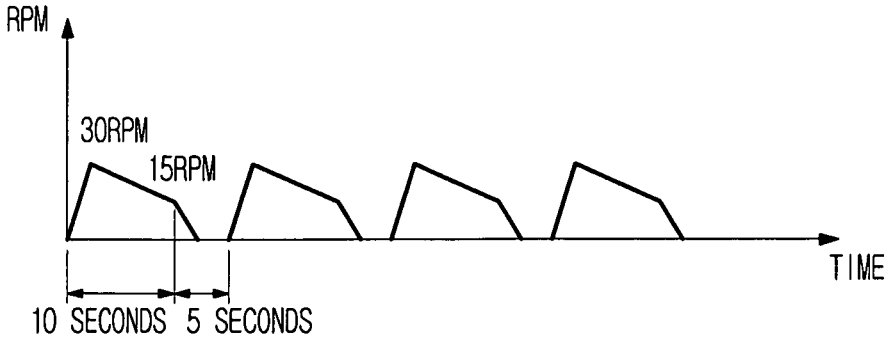
Figure 7A:
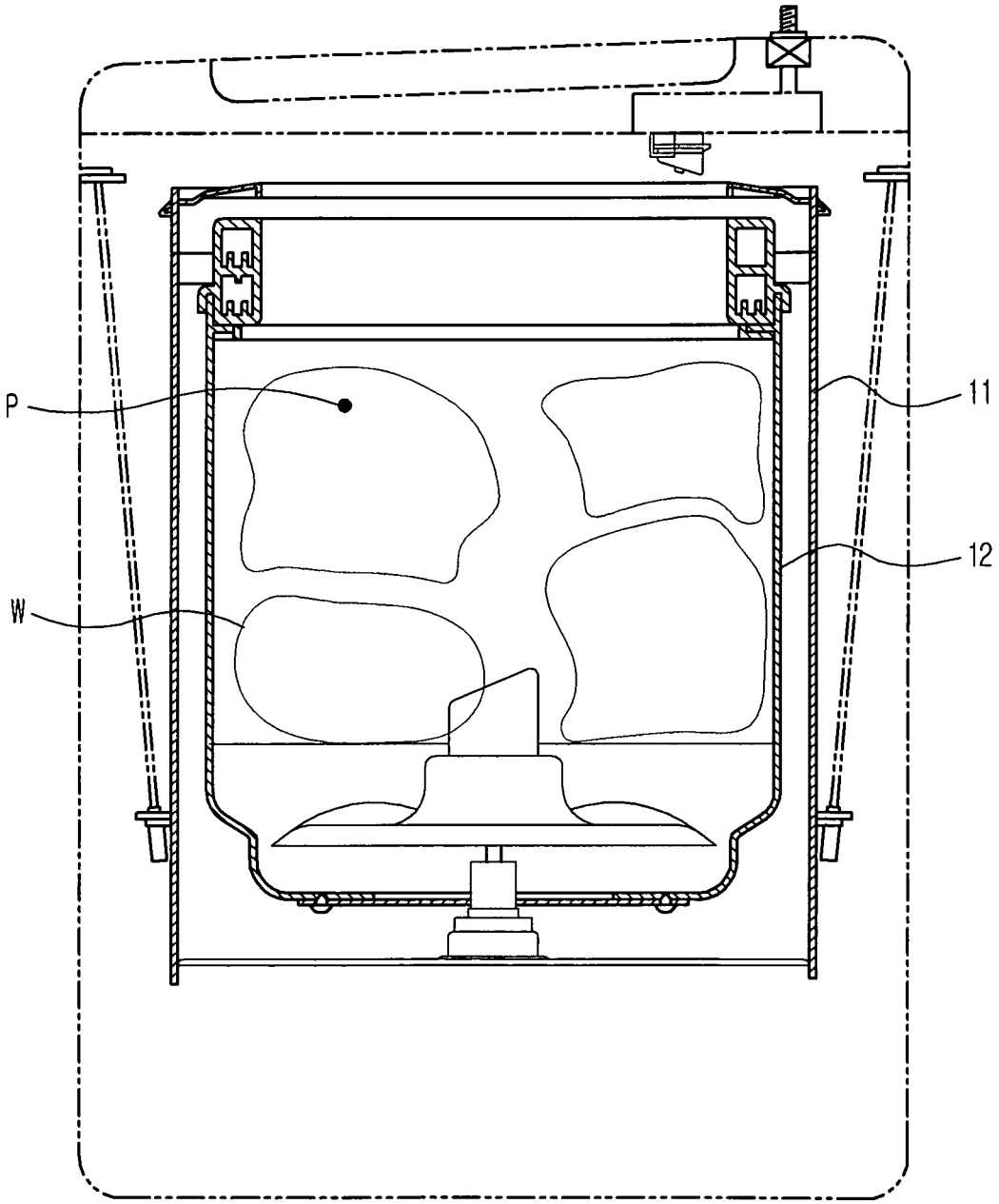
FIGS. 7A to 7D are views illustrating turnover of laundry during rinse water supply of the washing machine according to the embodiment of the present invention.
Figure 7B:
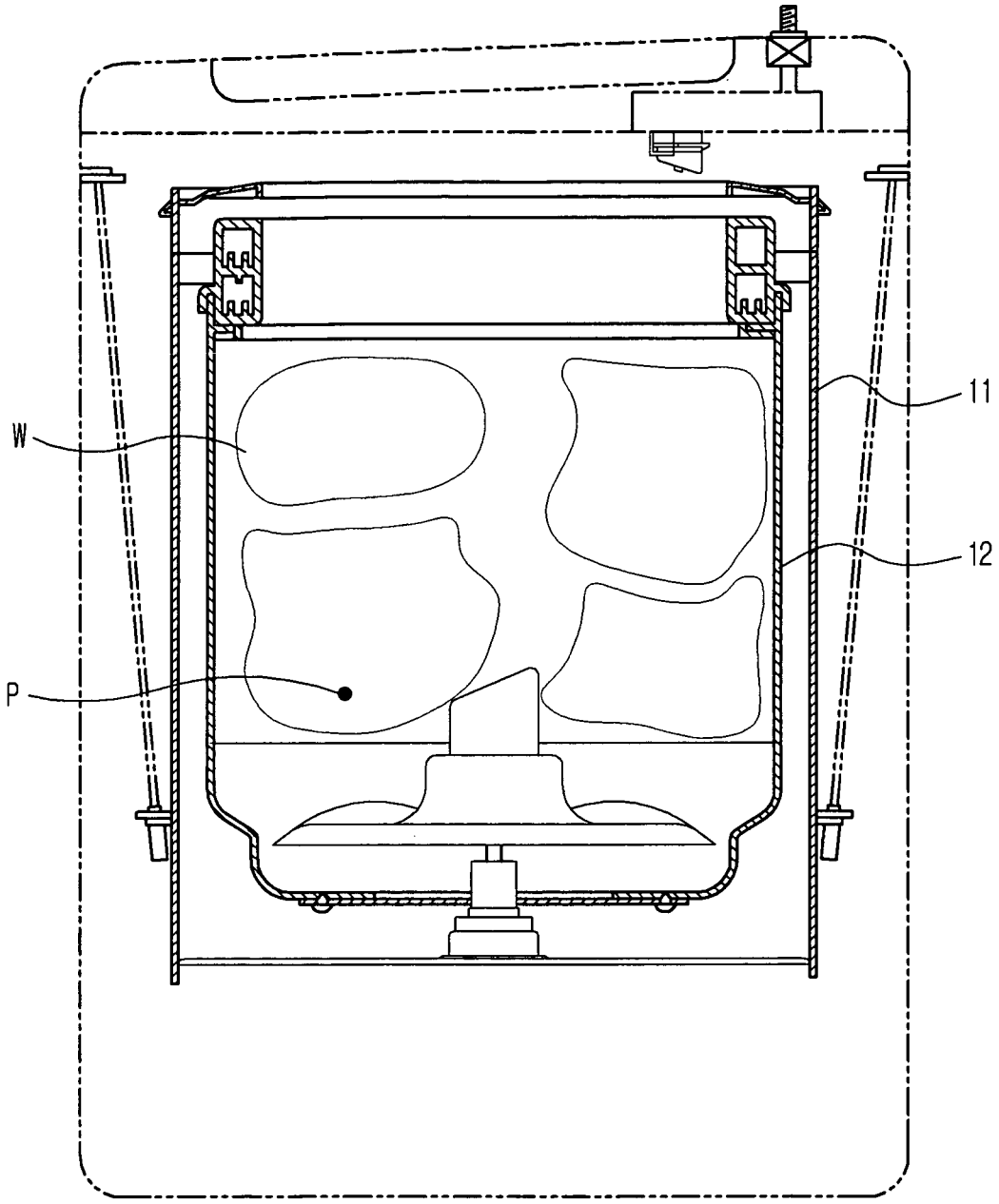
Figure 7C:
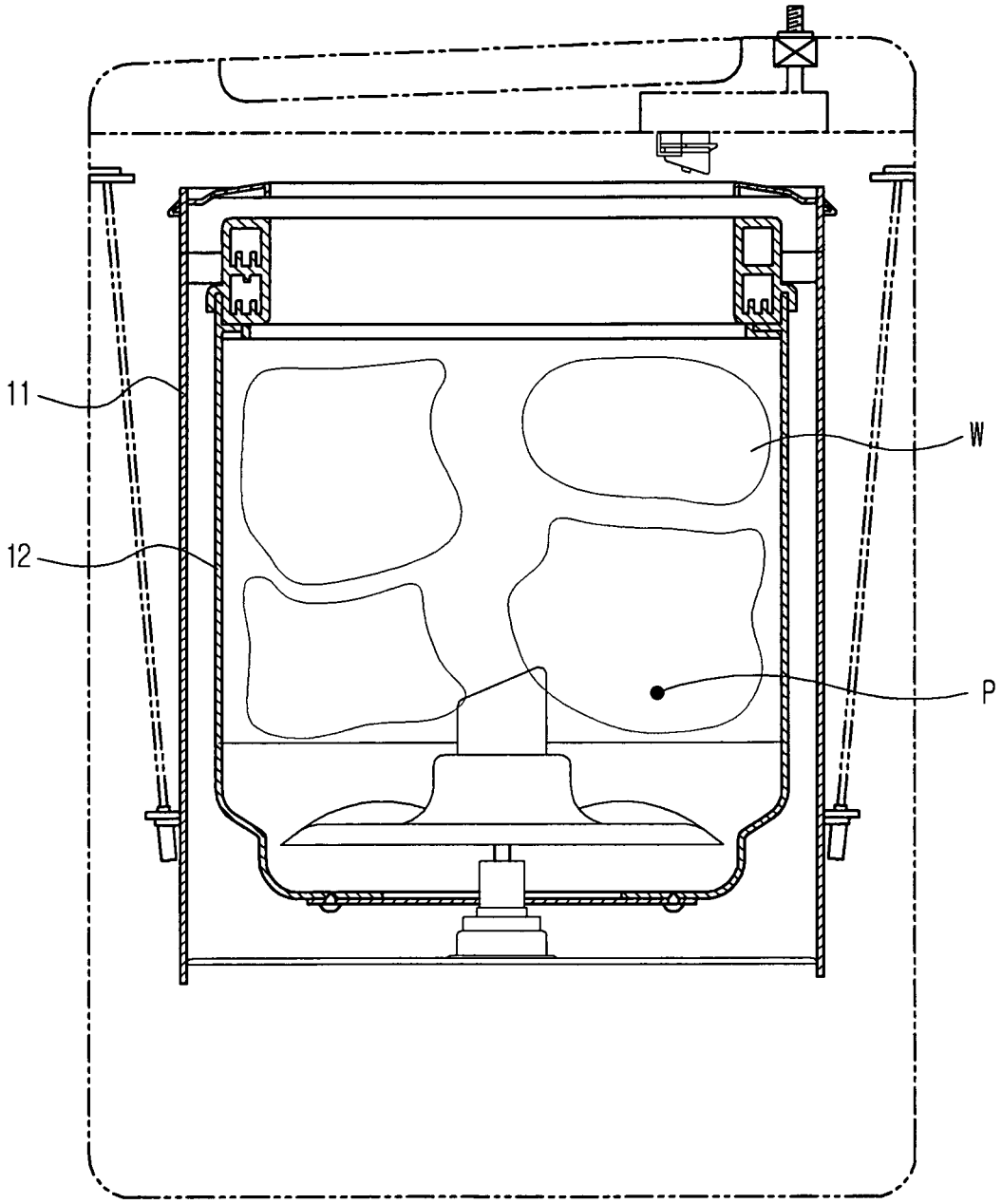
Figure 7D:
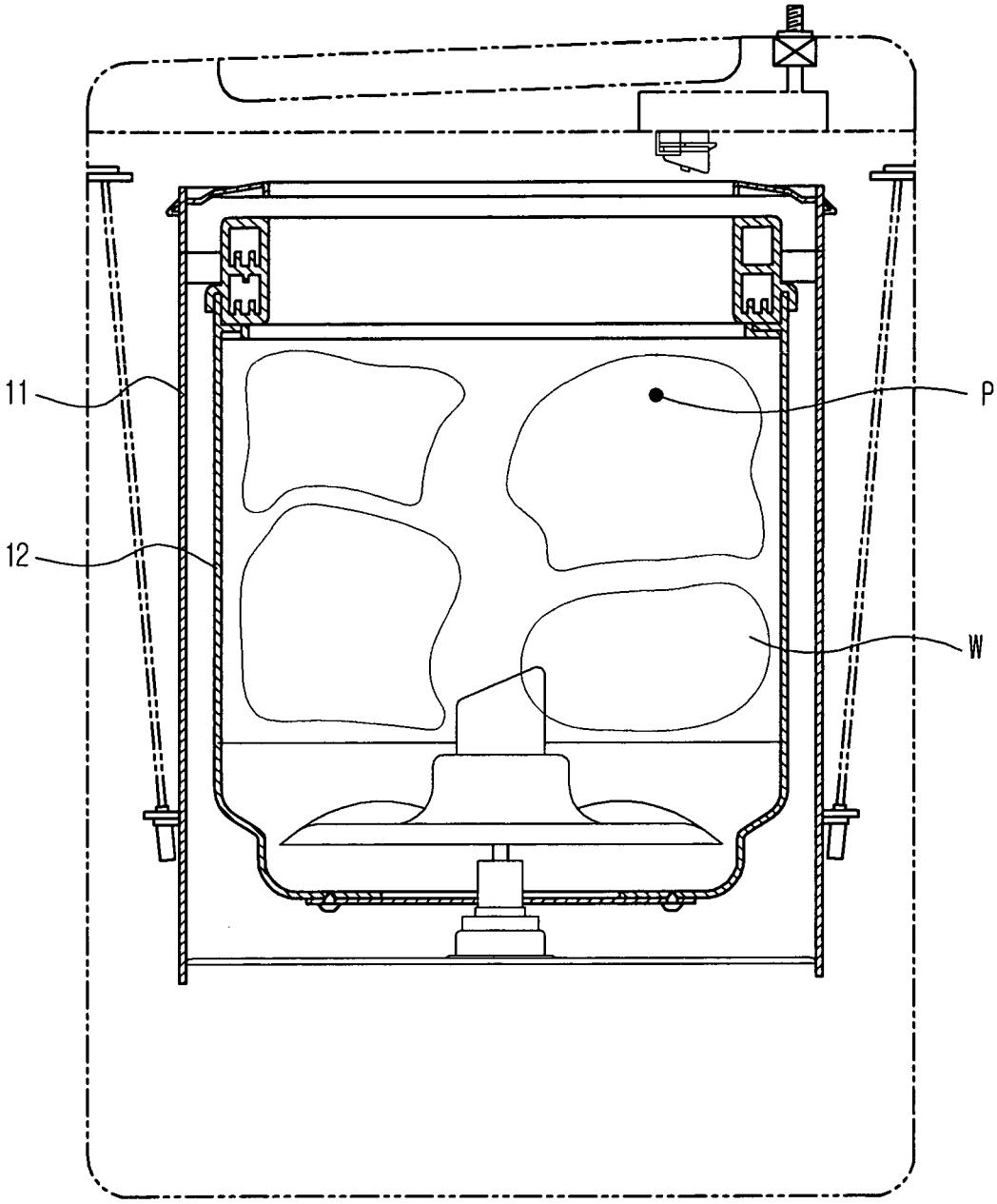

In FIG. 6D, the motor 14 is accelerated, decelerated, and stopped at an operation rate of 10-second motor on/5-second motor off to simultaneously rotate the washing tub 12 and the pulsator 13 in one direction, thereby improving wetting of the laundry W.

When the motor 14 is driven in the clockwise or counterclockwise direction according to any one of the drive modes of FIGS. 6A to 6D, the washing tub 12 and the pulsator 13 are simultaneously rotated in one direction, as shown in FIG. 5B.

During the supply of water during unidirectional rotation in which the water is supplied while the washing tub 12 and the pulsator 13 are simultaneously rotated in one direction, a frequency changing depending upon the level of the water supplied to the water tub 11 is sensed by the water level sensor 18, and it is determined whether the water has reached a first water level (126). When it is determined that the water has not reached the first water level, the supply of water during unidirectional rotation is continued.

Figure 5C:
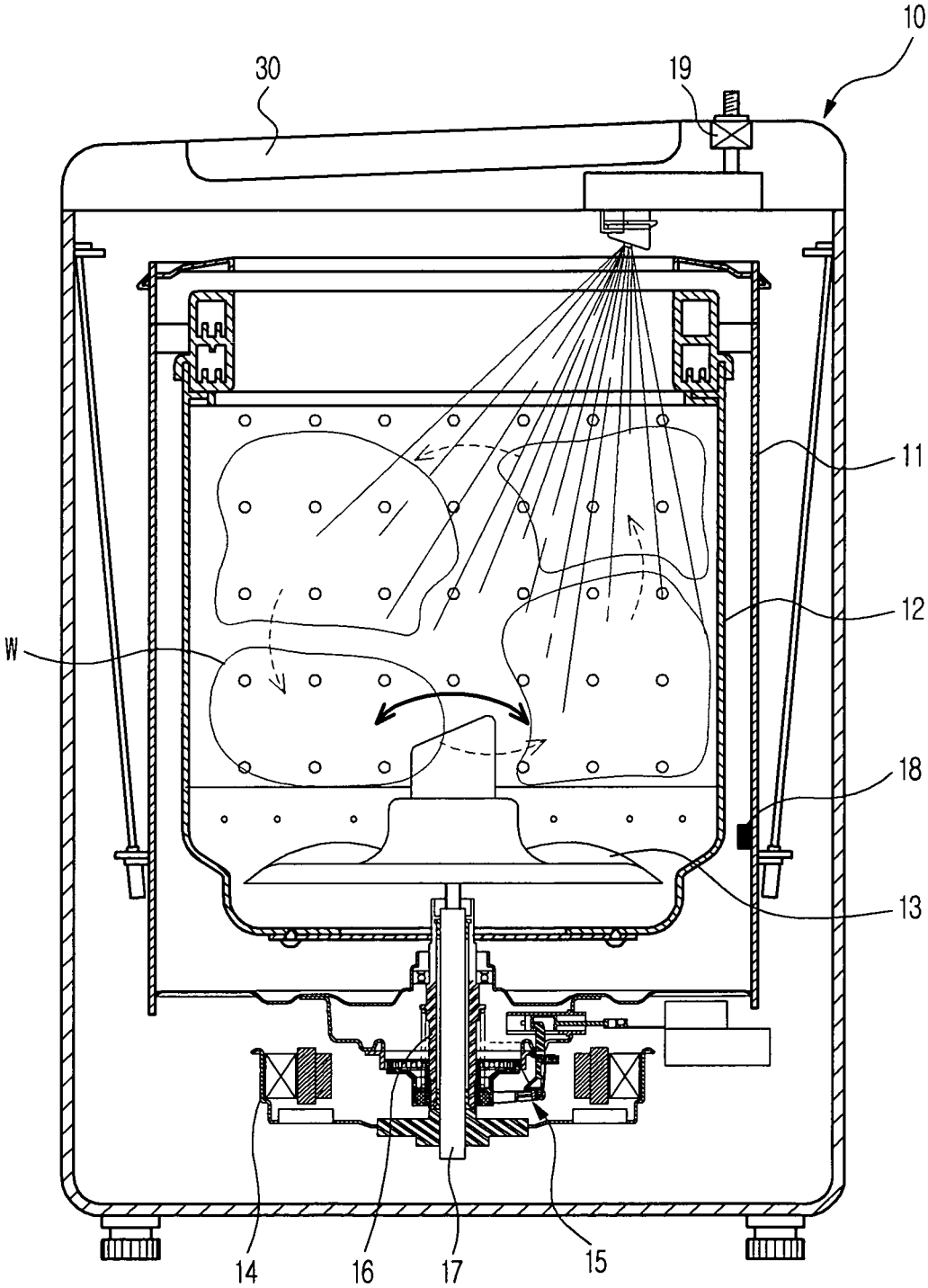

When it is determined at Operation 126 that the water has reached the first water level, the controller 70 controls the motor 14 to be driven to rotate only the pulsator 13 in alternating directions, as shown in FIG. 5C, to perform the supply of water during alternating-direction rotation (128).

For the supply of water during alternating-direction rotation in which the water (rinse water) is supplied while only the pulsator 13 is rotated in alternating directions, as shown in FIG. 5C, the power switching unit 15 is moved upward to selectively transmit a drive force from the motor 14 to the pulsator 13.

Even at the moment when switching is performed from the supply of water during unidirectional rotation to the supply of water during alternating-direction rotation, the water supply valve 19 remains open to continuously supply water irrespective of the upward and downward movement of the power switching unit 15.

When the power switching unit 15 is moved upward, the drive force from the motor 14 is transmitted only to the washing shaft 17, with the result that only the pulsator 13 is rotated. At this time, a target RPM of the motor 14 to rotate the pulsator 13 is approximately 130 RPM, and an operation rate (motor on-off time) is set to 0.6-second motor on/1.2-second motor off. The motor on/off is repeatedly performed to slightly separate the laundry W, clinging to the wall of the washing tub 12, from the washing tub 12 with a small intensity, such as a water current to untangle the laundry.

When the water (rinse water) is supplied while the pulsator 13 is rotated in alternating directions in this manner, the laundry W, clinging to the washing tub 12, is slightly separated from the washing tub 12, thereby easily achieving turnover of the laundry W such that washing residues (specifically, foreign matter such as detergent waste and lint) present on the laundry are effectively removed downward from the laundry, thereby improving rinsing efficiency.

During the supply of water during alternating-direction rotation in which the water is supplied while the pulsator 13 is rotated in alternating directions, a frequency changing depending upon the level of the water supplied to the water tub 11 is sensed by the water level sensor 18, and it is determined whether the water has reached a second water level (130). When it is determined that the water has not reached the second water level, the supply of water during alternating-direction rotation is continued.

Figure 5D:
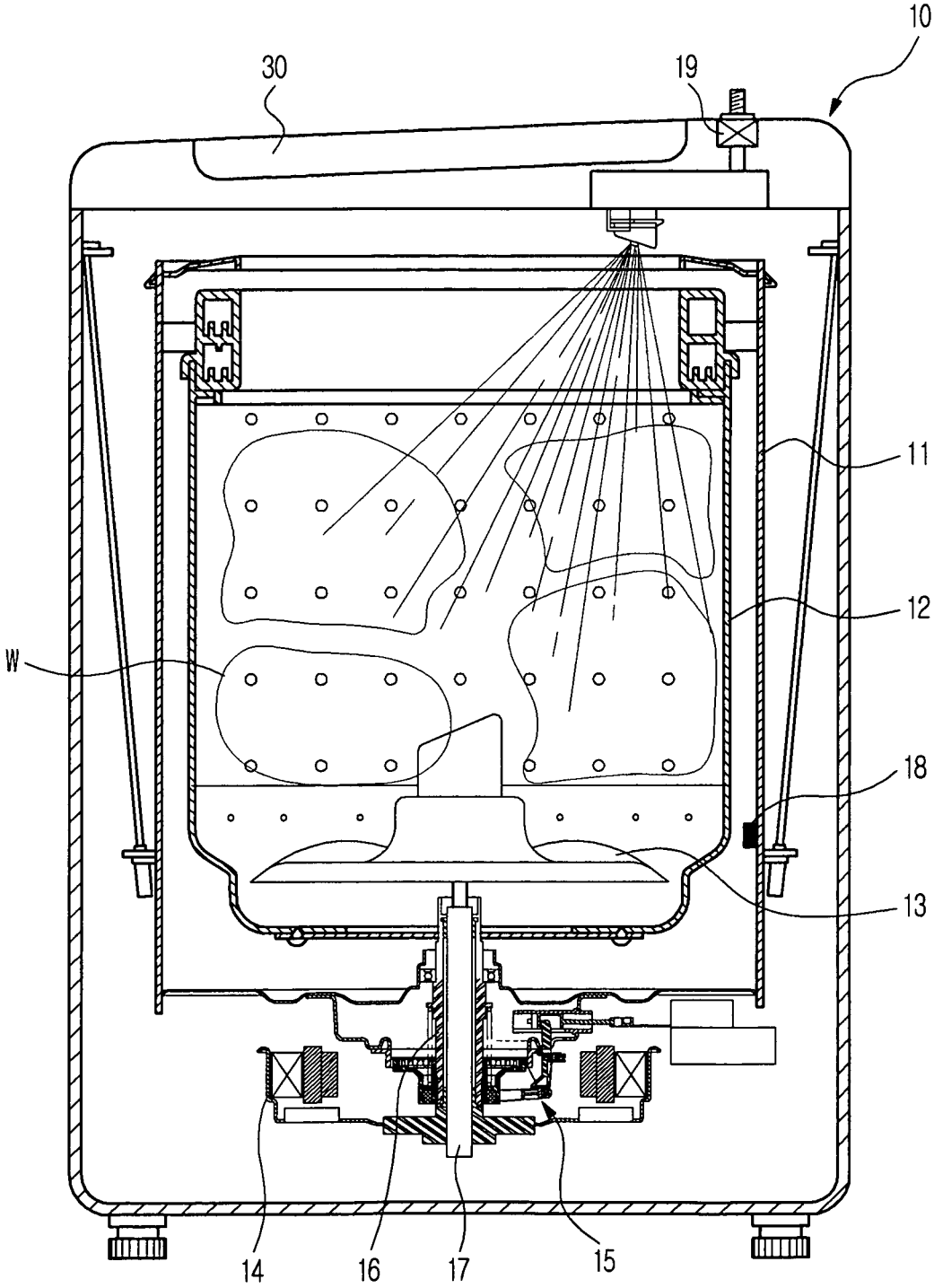

When it is determined at Operation 130 that the water has reached the second water level, the controller 70 controls the motor 14 to be stopped and, as shown in FIG. 5D, performs the supply of water during no rotation in which the water (rinse water) is supplied while the motor 14 is stopped (132).

Even at the moment when switching is performed from the supply of water during alternating-direction rotation to the supply of water during no rotation, the water supply valve 19 remains open to continuously supply water irrespective of whether the motor 14 is driven or not.

When the water (wash water) is supplied while the motor 14 is stopped, as shown in FIG. 5D, a third water level necessary for the rinsing operation is accurately obtained.

During the supply of water during no rotation in which the water is supplied while the motor 14 stopped, a frequency changing depending upon the level of the water supplied to the water tub 11 is sensed by the water level sensor 18, and it is determined whether the water has reached a third water level (134). When it is determined that the water has not reached the third water level, the supply of water during no rotation is continued.

When it is determined at Operation 134 that the water has reached the third water level, the controller 70 controls the water supply valve 19 to be turned off to stop the supply of rinse water (136).

When the supply of water to the third water level is completed, the controller 70 controls the motor 14 to be driven to rotate the pulsator 13 in alternating directions. As a result, a water current to cause water (rinse water) to contact the laundry W is generated, and the rinsing operation is performed (138)

When the rinsing operation is completed (140), a subsequent operation is performed (142).

In this manner, the washing machine according to this embodiment performs the supply of rinse water through three stages. As shown in FIG. 2, the supply of water during unidirectional rotation (first stage) in which the water is supplied while the washing tub 12 and the pulsator 13 are simultaneously rotated in one direction is performed from the commencement of water supply to the first water level (the sixth rinse water level based on the highest water level), the supply of water during alternating-direction rotation (second stage)

in which the water is supplied while the pulsator 13 is rotated in alternating directions is performed from the first water level (the sixth rinse water level based on the highest water level) to the second water level (the rinse water level between the seventh water level and the eighth water level based on the highest water level, specifically the water level corresponding to the target water level+500 Hz), and the supply of water during no rotation (third stage) in which the water is supplied while the motor 14 is stopped is performed from the second water level (the rinse water level between the seventh water level and the eighth water level based on the highest water level, specifically the water level corresponding to the target water level+500 Hz) to the third water level (target rinse water level).

In comparison between the amounts of water supply based on the water levels during the rinsing operation, the amount of water supplied to the first water level (the amount of water supplied from the commencement of water supply to the sixth rinse water level) is the largest, the amount of water supplied to the second water level (the amount of water supplied from the sixth rinse water level to the target water level+500 Hz) is less than the amount of water supplied to the first water level, and the amount of water supplied to the third water level (the amount of water supplied from the target water level+500 Hz to the target rinse water level) is less than the amount of water supplied to the second water level (See FIG. 2).

Turnover of the laundry Win the washing tub 12 by controlling the supply of rinse water is shown in FIGS. 7A to 7D.

FIGS. 7A to 7D are views illustrating turnover of laundry during rinse water supply of the washing machine according to the embodiment.

During the supply of rinse water, as shown in FIGS. 7A to 7D, the laundry W is rotated, while the laundry W is slightly separated from the wall of the washing tub 12, through the supply of water during unidirectional rotation in which the water is supplied while the washing tub 12 and the pulsator 13 are simultaneously rotated in one direction and the supply of water during alternating-direction rotation in which the water is supplied while the pulsator 13 is rotated in alternating directions, with the result that the laundry W is sufficiently mixed with the water, and the turnover of the laundry W (See the change in position of a reference point P) is smoothly achieved, thereby improving rinsing efficiency.

As is apparent from the above description, during the supply of water for the washing operation, the wetting of the laundry is improved through the supply of water in unidirectional rotation in which the water is supplied while the washing tub and the pulsator are simultaneously rotated in one direction, thereby achieving smooth movement of the laundry and thus improving washing efficiency.

Also, during the supply of water for the rinsing operation, laundry clinging to the washing tub due to spin-drying after the completion of the washing operation is quickly separated from the washing tub, such that the laundry is sufficiently mixed with the water, through the supply of water in unidirectional rotation in which the water is supplied while the washing tub and the pulsator are simultaneously rotated in one direction and the supply of water in alternating-direction rotation in which the water is supplied while only the pulsator is rotated in alternating directions, thereby achieving rinsing utilizing water supply time, and, in addition, turnover of the laundry is smoothly achieved such that washing residues (specifically, foreign matter such as detergent waste and lint) present on the laundry are effectively removed from the laundry, thereby improving rinsing efficiency.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method of controlling a water supply of a washing machine including a washing tub and a pulsator rotatably installed in the washing tub, the method comprising:

a load detecting stage for detecting a weight of laundry placed in the washing tub;

a target water level setting stage for determining a target water level according to the detected load;

an initial water supply stage of supplying and storing water to a reference water level lower than the target water level while rotating the washing tub and the pulsator in one direction;

a stopping stage for stopping the rotation of the tub and the pulsator while the water is continuously supplied to the tub; and a subsequent water supply stage of supplying and storing water to the target level in a state that the washing tub and the pulsator are stopped to provide for accurate determination of the target level.

2. The method according to claim 1, wherein the washing tub and the pulsator are rotated at a speed of less than approximately 40 RPM when performing the initial water supply stage.

3. The method of claim 1, further comprising a third water supply stage of supplying and storing water to a level between the reference water level and the target water level, while alternately rotating the pulsator.

4. The method according to claim 3, wherein the washing machine further comprises:

a motor to generate a drive force to rotate the washing tub and the pulsator;

a spin-drying shaft coupled to the washing tub;

a washing shaft provided at the spin-drying shaft to transmit the drive force from the motor to the pulsator; and a power switching unit to selectively transmit the drive force from the motor to the spin-drying shaft, and the drive force from the motor is transmitted to the spin-drying shaft and the washing shaft to simultaneously rotate the washing tub and the pulsator according to a downward movement of the power switching unit when performing the first water supply stage.

5. The method according to claim 4, wherein the drive force from the motor is transmitted to the washing shaft to rotate the pulsator according to an upward movement of the power switching unit when performing the third water supply stage.

6. The method of claim 3, wherein the third water supply stage is provided between the first water supply stage and the second water supply stage.

7. A washing machine comprising:

a washing tub to receive laundry;

a pulsator rotatably installed in the washing tub;

a motor to rotate the washing tub and the pulsator;

a water supply unit to supply water to the washing tub; and a controller configured to control the water supply unit to initially supply water to the washing tub and to control the motor to perform a first, initial water supply stage to rotate the washing tub and the pulsator, the first, initial water supply stage including simultaneously rotating the washing tub and the pulsator to increases wetting of the laundry to sink the laundry during the initial supply of water, decrease a distance between the laundry and the pulsator, and increases a movement of the laundry to increase effectiveness of the initial water supply stage, and a second, subsequent water supply stage, the second, subsequent water supply stage including stopping the washing tub and the pulsator, according to a predetermined water level during the supply of water, to provides for accurate determination of the predetermined water level.

8. The washing machine according to claim 7, wherein the controller controls the washing tub and the pulsator to be rotated in a clockwise or counterclockwise direction when performing the first water supply stage.

9. The washing machine according to claim 8, wherein the controller controls the first water supply stage while rotating the motor at a speed of less than approximately 40 RPM.

10. The washing machine according to claim 7, further comprising:

a third water supply stage to rotate the pulsator in alternating directions, wherein the controller determines whether the supply of water is for a rinsing operation, and continuously performs the first water supply stage, the third water supply stage and the second water supply stage when the supply of water is for the rinsing operation.

11. The washing machine according to claim 7, wherein the controller determines whether the supply of water is for a washing operation, and performs the first water supply stage and the second water supply stage when the supply of water is for the washing operation.

12. The washing machine according to claim 11, wherein the controller controls the first water supply stage while changing an operation rate of the motor according to a washing course.

* * * * *

UNITED STATES PATENT AND TRADEMARK OFFICE

CERTIFICATE OF CORRECTION

PATENT NO. : 8,959,688 B2
APPLICATION NO. : 12/659460
DATED : February 24, 2015
INVENTOR(S) : Tae Hui Im et al.

It is certified that error appears in the above-identified patent and that said Letters Patent is hereby corrected as shown below:

In the Claims

Claim 7, column 12, line 63, delete “increases” and insert --increase--, therefor.

Claim 7, column 13, line 4, delete “provides” and insert --provide--, therefor.

Signed and Sealed this
Seventh Day of July, 2015

Michelle K. Lee

Michelle K. Lee
*Director of the United States Patent and Trademark Office*